US008082861B2

(12) United States Patent
Lovelady et al.

(10) Patent No.: US 8,082,861 B2
(45) Date of Patent: Dec. 27, 2011

(54) APPARATUS AND METHOD FOR FORMING LEVEL CUT AND LOOP PILE TUFTS AND RELATED FABRICS

(75) Inventors: Brian K. Lovelady, Soddy Daisy, TN (US); Michael L. Kilgore, Whitwell, TN (US)

(73) Assignee: Tuftco Corporation, Chattanooga, TN (US)

( * ) Notice: Subject to any disclaimer, the term of this patent is extended or adjusted under 35 U.S.C. 154(b) by 570 days.

(21) Appl. No.: 12/201,863

(22) Filed: Aug. 29, 2008

(65) Prior Publication Data

US 2009/0056606 A1 Mar. 5, 2009

Related U.S. Application Data

(60) Provisional application No. 60/968,793, filed on Aug. 29, 2007.

(51) Int. Cl.
*D05C 15/20* (2006.01)
*D05C 15/26* (2006.01)

(52) U.S. Cl. ..... 112/80.51; 112/80.54; 112/80.56; 112/80.7

(58) Field of Classification Search ..... 112/80.4–80.5, 112/100

See application file for complete search history.

(56) References Cited

U.S. PATENT DOCUMENTS 2,990,792 A * 7/1961 Nowicki et al. ..... 112/80.52
3,025,807 A * 3/1962 Gebert ..... 112/80.52
3,919,953 A * 11/1975 Card et al. ..... 112/80.45
6,155,187 A 12/2000 Bennett et al.
6,834,602 B1 12/2004 Hall
7,490,566 B2 2/2009 Hall

* cited by examiner

*Primary Examiner* — Ismael Izaguirre
(74) *Attorney, Agent, or Firm* — Miller & Martin PLLC

(57) ABSTRACT

A tufting machine is provided with two transverse rows of needles, one row being associated with transverse row of loopers and the other second row of needles being associated with a transverse row of gated hooks. Novel and low pile height tufted fabrics can be created with this configuration.

20 Claims, 4 Drawing Sheets

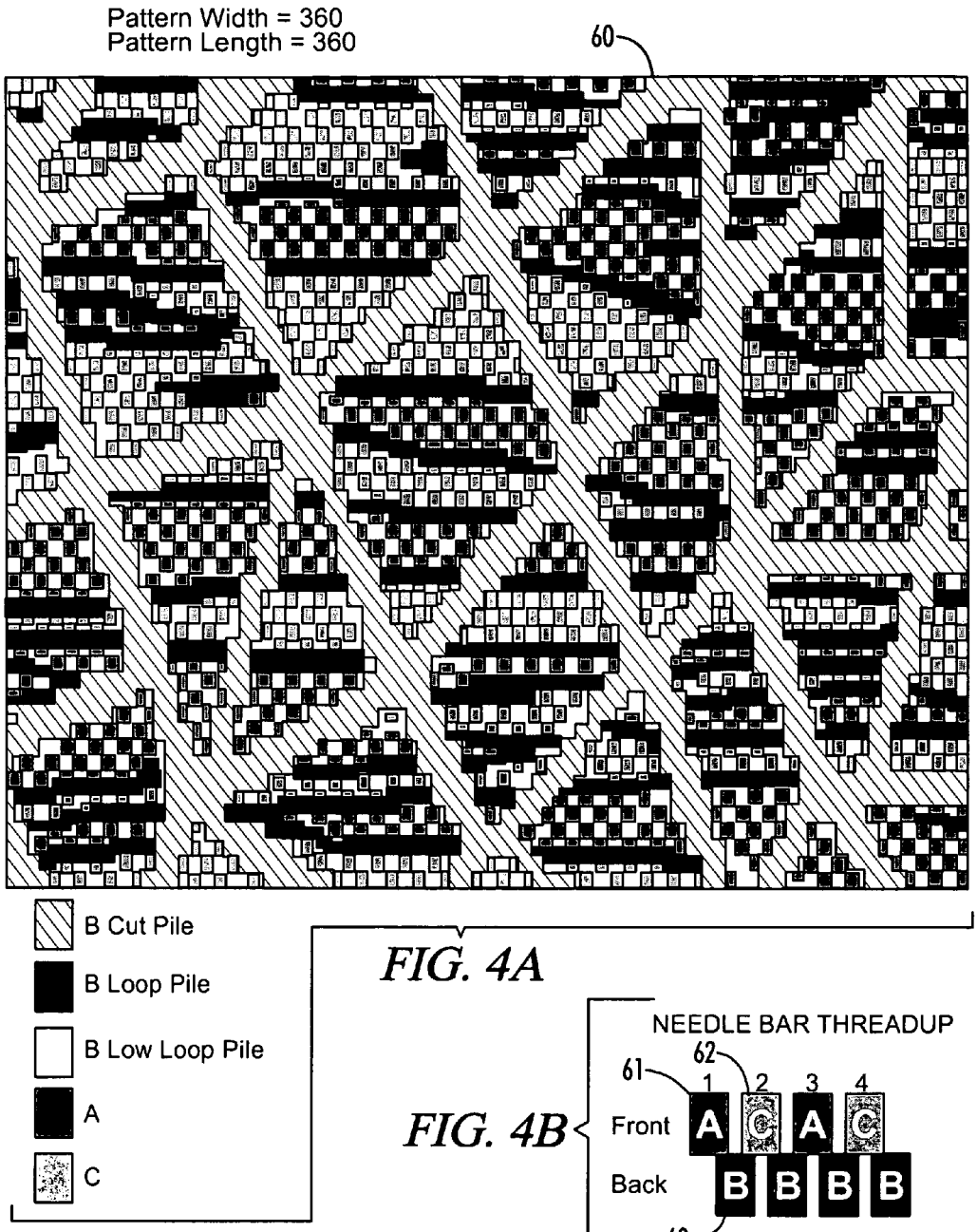
FIG. 4A
FIG. 4B
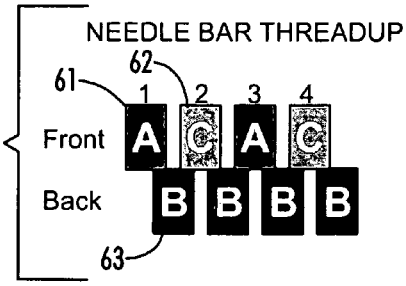

PILE HEIGHT INFORMATION
| Front Bar 2 Pile Heights | Back Bar 3 Pile Heights |
|---|---|
| PH#1 = 0.1500"<br>PH#2 = 0.2990" | PH#1 = 0.2400"<br>PH#2 = 0.2990"<br>PH#3 = 0.3000" |
65 66 67 68 69
FIG. 4C
HIGH LOOP (PILE HEIGHT LEVEL 2 FROM BOTH FRONT AND REAR BARS - ▨) WILL BE AT SAME LEVEL AS CUT PILE
Pattern Width = 360
Pattern Length = 360
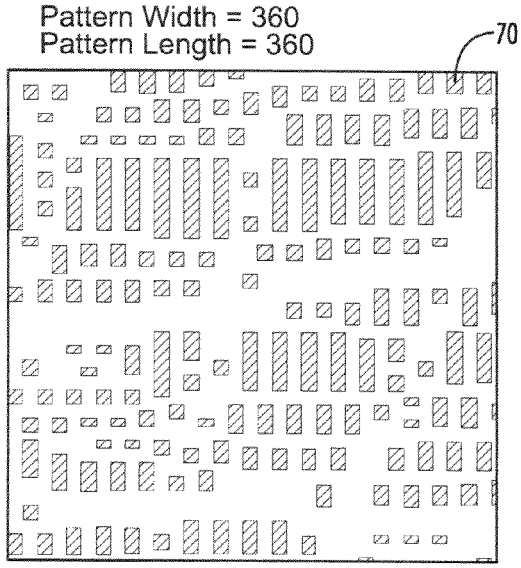
Front scroll
FIG. 4D
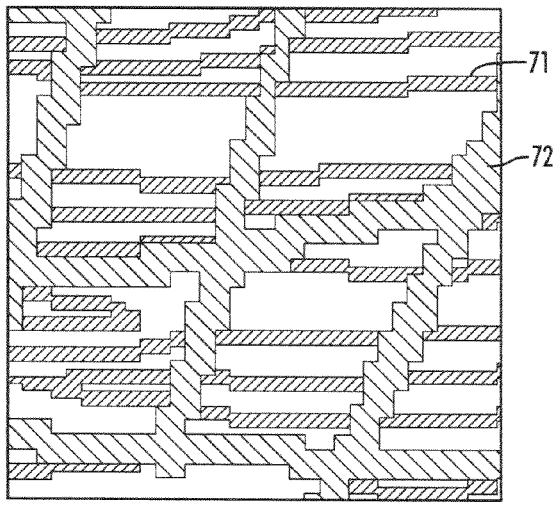
Back scroll
FIG. 4E
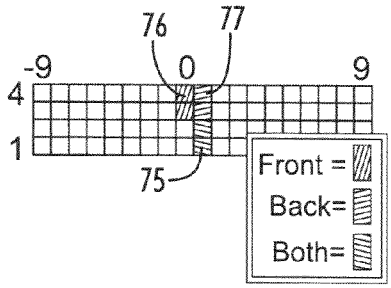
FIG. 4F

APPARATUS AND METHOD FOR FORMING LEVEL CUT AND LOOP PILE TUFTS AND RELATED FABRICS

The present application claims priority for U.S. Provisional Patent Application Ser. No. 60/968,793 filed Aug. 29, 2007.

FIELD OF THE INVENTION

The present invention relates to the manufacture of tufted fabrics and particularly to the use of a gated hook apparatus cooperating with a first row of needles in combination with loopers cooperating with a second row of needles, to produce novel fabrics.

BACKGROUND OF THE INVENTION

In the field of tufting carpets, it has been known to tuft carpets having spaced rows of looped pile and cut pile tufts. A variety of techniques have been utilized to obtain cut and loop pile tufts in the same carpet pattern. For example, U.S. Pat. No. 3,919,953 discloses an apparatus and method for tufting spaced rows of loop pile and cut pile tufts formed in the backing material using a multi-needle tufting machine having two transverse rows of needles with each row cooperating with a series of loop pile loopers or cut pile loopers.

A variety of techniques have also been developed to form cut pile and loop pile stitches in the same row, as for instance by utilizing spring clips permitting loops of yarn to be withdrawn from a looper by backrobbing as described in U.S. Pat. Nos. 3,084,465; 4,155,319; and 4,522,132. A similar result has also been obtained through the use of pusher devices as in U.S. Pat. No. 4,320,711 to selectively push loops off the loopers before the loops are cut.

Level cut and loop pile has also been formed in the same rows of stitches as in U.S. Pat. Nos. 4,134,347; 4,185,569; 6,155,187 and 7,222,576 utilizing a gate structure. Gates are selectively opened and closed to promote passage of selected loops into the knife blade cooperating with the looper or hook.

The improvements to the design of Card, U.S. Pat. No. 3,199,953 have been numerous. The style of carpet created by this design is variously referred to as Precision Cut/Uncut™ or Velva Loop™. An initial improvement to this machine design having separate cutting and looping systems under the backing fabric, was the addition of a pattern yarn feed attachment to the yarns being fed to the needles associated with the looping attachment. This improvement permitted yarns to be fed at about three different rates using clutch scroll attachments to achieve variation in loop tuft heights. Today, with servo scroll and single end scroll attachments, loop patterning with precision height variation is possible. The loop patterning permits loops to be tufted at heights equal to or lower than the yarns being tufted by the needles associated with the cutting system. Tufting loops at heights greater than the yarns tufted by the needles associated with the cutting system frequently leads to loops being seized on the hooks and being cut or fouling the action.

A further improvement to the tufting machine design with separate cutting and looping systems under the backing fabric was added when a sculptured cutting apparatus as depicted in U.S. Pat. No. 4,557,209 was added to the cut pile side of the tufting machine. With this configuration, and utilizing a pattern control yarn feed, it became possible to slightly sculpt the height of the cut pile tufts. With pattern control yarn feed on the loop pile side, the heights of the loop pile tufts could also be varied.

Yet another improvement to the Precision Cut/Uncut™ or Velva Loop™ systems was the addition of spring clips on the cut side loopers or hooks. In this configuration, if the yarn to the needles on the cut pile side is fed in normal increments, the tufts are produced in cut pile at full height. However, if the yarn is backrobbed or highly tensioned, the loops pull off of the hooks before proceeding to the cutting zone. The backrobbing or yarn tension causes the loops to be formed from less yarn than the cut pile tufts. Thus, the hooks equipped with spring clips produce a combination of full height cut tufts and lower height loop tufts. By utilizing a pattern control yarn feed on the loop pile side together with hooks having spring clips on the cut pile side, it is possible to make patterns with loops tufted on the loop side lower than most of the low loops on the cut pile side. When the loop pile side loops are this low, effectively buried, the yarns from the cut side needles may be shown as either cut pile tufts or loop tufts. The yarns from the loop side needles may also be fed at higher rates and be shown as loops either concealing yarns from the cut side or allowing a portion of the cut side yarns to show.

The process of backrobbing or highly tensioning yarns so that yarn loops are removed from the hooks before proceeding to the cutting zone is not precisely controllable, largely due to the elasticity of yarns. Accordingly the hooks are usually set beneath the backing fabric so that the cut pile height is at least $5/16^{th}$ inch and more commonly $3/8^{th}$ inch. At this pile height, the spacing between the hooks and the backing fabric gives the yarn an instant to reduce its tension after a yarn loop is removed from a hook and lessens the possibility of the loop snapping through the backing. If a lower cut pile height is used, there is a likelihood that some tufts will be completely pulled out of the backing fabric by the yarn tension necessary to pull the yarn loops off of the hooks. A $3/8^{th}$ inch pile height consumes more yarn than lower pile heights, and for many carpet designs is unnecessarily tall.

Therefore, it can be seen that a need exists for an improved method and system of forming cut and loop pile tufts on the cut side of tufting machine having separate cutting and looping systems below the backing fabric that addresses the foregoing and related problems in the art.

SUMMARY OF THE INVENTION

The present invention may include a conventional tufting machine provided with a reciprocating needle bar support which in turn carries a pair of front and back, laterally shiftable needle bars positioned on the common needle bar support. The needles of a front needle bar cooperate with loop pile loopers beneath the backing fabric and the needles of a second needle bar cooperate with the cut-loop loopers. Yarn feed controls respectively feed yarn to the needles accordingly to prescribed patterns. The needle bars may be shifted laterally in accordance with those patterns. However, the cut-loop loopers of the present invitation are not hooks equipped with spring clips, but are instead gated loopers typified by those shown in U.S. Pat. No. 7,222,576, which is incorporated herein by reference. The enhanced design choices provided by gated loopers has not previously been recognized as beneficial in creating Precision Cut/Uncut™ or Velva Loop™ style fabrics. However, it has been discovered that through the use of gated hooks on the cut side, two significant benefits are achieved. First, since loops are formed by closing a gate rather than backrobbing with yarn tension, both cut pile tufts and loop pile tufts created from the yarns fed to the cut side of the tufting machine are tufted at very nearly the same height. The cut pile tufts tend to be slightly higher than loop pile tufts as the cut yarns tend to bloom and stand more upright from the backing fabric. This produces a new surface appearance for fabrics having cut and loop tufts in the same rows of stitches that is more level overall. Of course, when desired, a certain amount of height variation in both cut and loop tufts can still be achieved with yarn feed control and preferably a servo driven yarn feed apparatus.

A second significant and unexpected advantage of utilizing gated loopers rather than yarn tension to create loops on the cut loop side of the tufting machine is that the operation of the tufting action is smoother with gated loopers. With gated loopers there is no concern with backrobbing yarns to the extent that tufts are pulled from the backing fabric. Accordingly, it is possible to tuft yarns at a lower height, with cut pile having a pile height on the order of $\frac{1}{4}^{th}$ inch rather than $\frac{3}{8}^{th}$ inches or more. This enables yarn savings of as much as one-third of the face yarn on the cut loop side of the tufting machine, because both cut and loop stitches on the cut side of the machine can be tufted at lower pile heights. Overall yarn savings will typically run between 15-25% of the face yarns due to corresponding height reductions that may be achieved on the loop side of the tufting machine.

BRIEF DESCRIPTION OF THE DRAWINGS

Particular features and advantages of the present invitation will become apparent from the following description when considered in conjunction with the accompanying drawings in which:

FIG. 4A is a graphic representation of a carpet tufted on a machine configured according to the invention.

FIG. 4B depicts the needle bar thread up for the pattern of FIG. 4A.

FIG. 4C depicts the pile height information for the pattern of FIG. 4A.

FIG. 4D depicts the high loop stitches from the front needle bar in the pattern of FIG. 4A.

FIG. 4E depicts the cut pile and high loop stitches from the rear needle bar in the pattern of FIG. 4A.

FIG. 4F depicts the needle bar shifting pattern for the pattern of FIG. 4A.

DETAILED DESCRIPTION OF THE DRAWINGS

Figure 1:
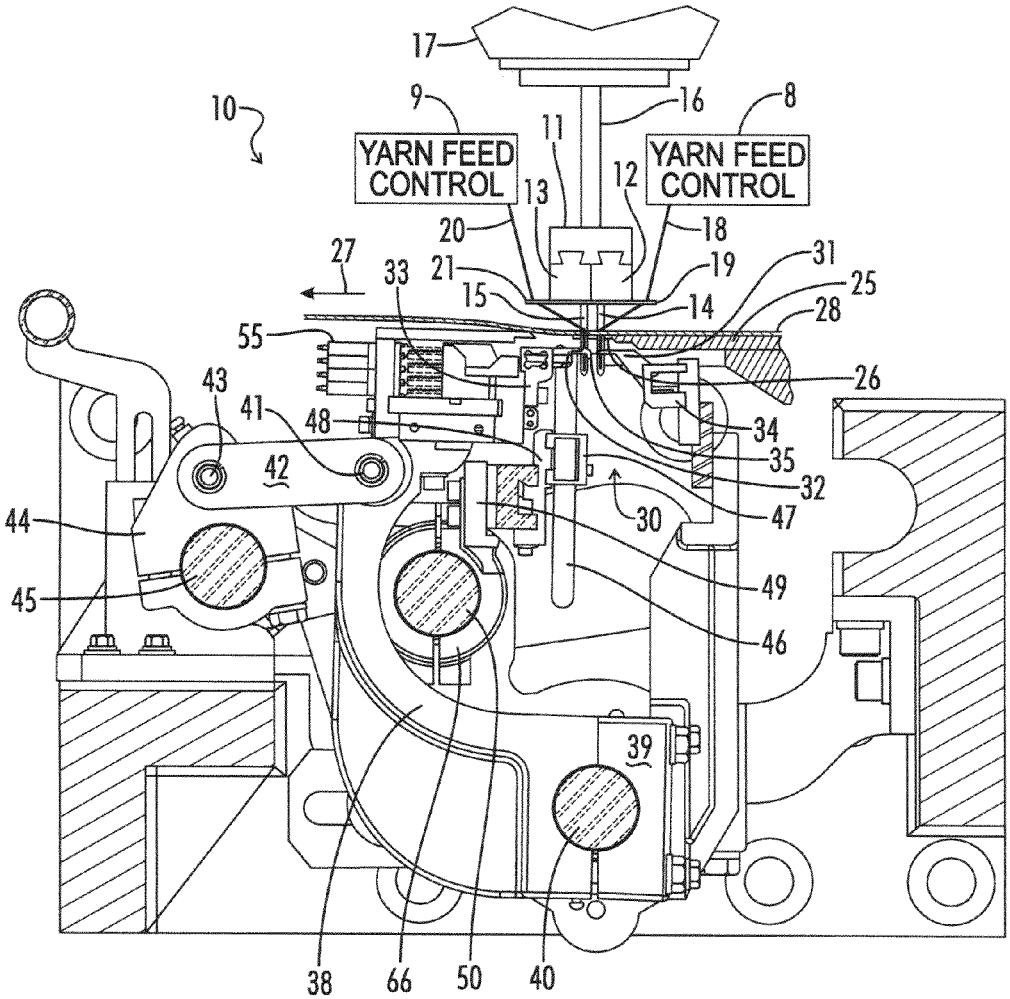
FIG. 1 is a partial sectional end view of a tufting machine constructed in accordance with the present invention.

Referring now to the drawings in more detail, FIG. 1 discloses a multiple needle tufting machine 10 including an elongated transverse needle bar carrier 11 supporting a front needle bar 12 and a rear needle bar 13. The front needle bar 12 supports a row of transversely spaced front needles 14, while the rear needle bar 13 supports a row of transversely spaced rear needles 15. The needle bar carrier 11 is connected to a plurality of push rods 16 adapted to be vertically reciprocated by conventional needle drive mechanism, not shown, within the upper housing 17.

Front yarns 18 are supplied to the corresponding front needles 14 through corresponding apertures in the front yarn guide plate 19 from a yarn supply, not shown, such as yarn feed rolls, beams, creels, or other known yarn supply means, preferably passing through front yarn feed control 8. In the same manner, rear yarns 20 are supplied to the corresponding rear needles 15 through corresponding apertures in the rear yarn guide plate 21 from a yarn supply, not shown, preferably passing through rear yarn feed control 9.

The front and rear needle bars 12,13 may be fixedly mounted to the needle bar carrier 11 or they may slide within the needle bar carrier 11 for transverse or lateral shifting movement by appropriate pattern control mechanisms, in well known manners.

The backing fabric 28 is supported upon the front needle plate 25 having rearward projecting transversely spaced front needle plate fingers 26, the fabric 28 being adopted for longitudinal movement from front-to-rear in a feeding direction, indicated by the arrow 27, through the tufting machine 10.

The needle drive mechanism, not shown, is designed to actuate the push rods 16 to vertically reciprocate the pair of needle bars 12, 13 to cause the front and rear needles 14, 15 to simultaneously penetrate the backing fabric 28 far enough to carry the respective yarns 18, 20, through the backing fabric 28 to form loops on the face thereof. After the loops are formed, the needles 14, 15 are vertically withdrawn to their elevated, retracted positions. A yarn seizing apparatus 30 in accordance with this invention includes a plurality of front loopers 31 and rear gated hooks 32, there preferably being one looper 31 for each front needle 14 and one gated hook 32 for each rear needle 15. Each front looper 31 is provided with a shank received in a corresponding slot in a looper bar 34. The front loopers 31 have the same transverse spacing or gauge as the front needles 14 and are so arranged that the bill 35 of each looper 31 is adapted to cross and engage its corresponding front needle 14 when the front needle is in its lower most position, to seize the yarn 18 and form a loop therein. The bills 35 of the loopers 31 point rearward in the direction of fabric feed 27 so that loops are easily shed from the loopers as the backing fabric moves from front to rear through the tufting machine.

Similarly, each gated hook 32 is provided with a shank received in a corresponding slot in a hook bar 33 in a conventional manner. The rear gated hooks 32 have the transverse spacing or gauge as the rear needles 15 and are so arranged that the bill of each hook 32 is adapted to cross and engage its corresponding rear needle 15 when the rear needle 15 is in its lower most position. Gated hooks 32 seize the yarn 20 and form a loop therein when the sliding gate is closed by an associated pneumatic cylinder 55, and to shed the loop as the gated hooks 32 are rocked.

The elongated, transverse hook bar 33 and associated pneumatic assembly are mounted on the upper end portion of a C-shaped rocker arm 38. The lower end of the rocker arm 38 is fixed by a clamp bracket 39 to a transverse shaft 40. The upper portion of the rocker arm 38 is connected by a pivot pin 41 to a link bar 42, the opposite end of which is connected by a pivot pin 43 to a radial arm 44 clamped to a driven looper shaft or jack shaft 45. The looper shaft 45 is driven or reciprocally rotated by conventional looper drive. Adapted to cooperate with each hook 32 is a knife 46 supported in a knife holder 47 fixed to knife block 48. The knife blocks 48 are fixed by brackets 49 to the knife shaft 50 adapted to be reciprocally rotated in timed relationship with the driven jack shaft 45 in a conventional manner. Each knife 46 is adapted to cut loops formed by each rear needle 15 upon the bill of the hook 32 from the rear yarn 20 when gates are retracted and yarn loops are received on the hooks 32. The preferred gated hook assembly is disclosed in U.S. Pat. No. 7,222,576 which is incorporated herein by reference.

Figure 2:
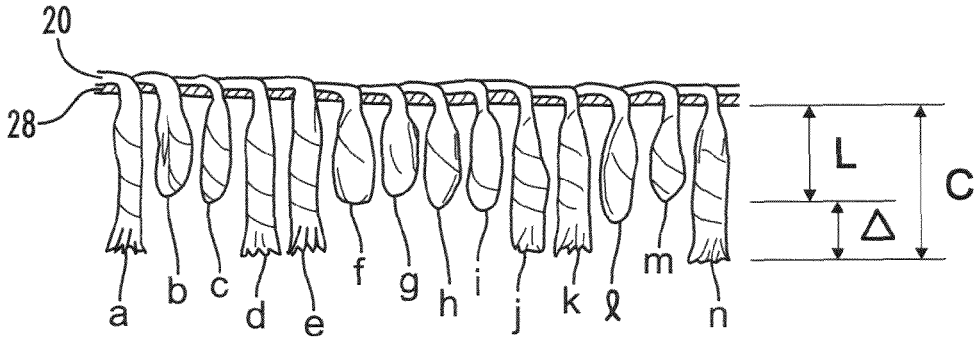
FIG. 2 (PRIOR ART)
FIG. 2 is an exemplary sectional side view of a prior art row of stitches tufted with yarn clips on the cut side of the tufting machine.
Figure 3A:
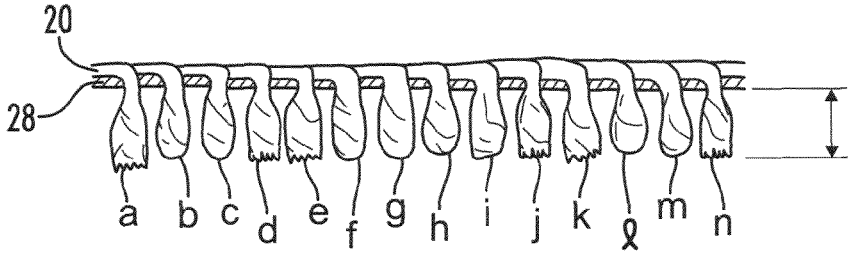
FIG. 3A is an exemplary sectional side view of a row of stitches tufted on the cut/loop side of a tufting machine constructed in accordance with the invention.

Examples of rows of stitches tufted utilizing apparatus to create cut and loop stitches in the same row are illustrated in FIG. 2 and FIG. 3A. FIG. 2 is representation of prior art stitches created with rear yarns being tufted on hooks fitted with spring clips by which tension or backrobbing is utilized to pull loops of rear yarn 20 off the hooks. Thus, for stitch a rear yarn 20 was fed normally when yarn 20 was tufted through backing fabric 28 and the yarn proceeded to the cutting area of the hook and produced a cut pile tuft a. In the next stitch the yarn was backrobbed or tensioned so that the yarn loop pulled from the hook and formed a loop tuft b. Similar loop tufts were formed in stitches c, f, g, h, i, l and m. In this prior art tufting it will be seen there is variation in the height of the loop pile stitches due to the difficulty of managing tension over a somewhat elastic length of yarn. The result is a row of stitches with a somewhat variable loop height. Setting the target height C for cut pile stitches at less than $3/8^{th}$ inch runs a risk of the loop stitches being tightly tensioned in such close proximity to the backing fabric 28 that the loop stitches may pull completely out of the backing fabric 28. The usual height differential between loop stitches and cut stitches is represented by Δ, and is about $3/16^{th}$ inches. Thus, the overall height of the cut pile tufts C is typically on the order of $3/8^{th}$ inches and is at least $5/16^{th}$ inch. So long as the cut pile height is adequate, the loop pile height L may be quite low.

FIG. 3A depicts cut and loop stitches tufted with rear yarns 20 and utilizing a tufting machine with a gated hook apparatus. In this instance, the cut stitches a, d, e, j, k and n are very nearly the same height as the loop stitches b, c, f, g, h, i, l, m. Because of the relative smoothness of operation of gated looper apparatus, a stitch height of only about $1/4^{th}$ of an inch for both cut and loop pile stitches is necessary.

Figure 3B:
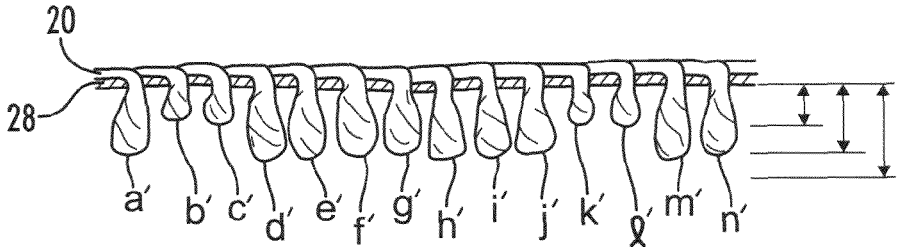
FIG. 3B is an exemplary sectional side view of a row of stitches tufted on the loop side of a tufting machine constructed in accordance with the invention.

Finally, FIG. 3B illustrates representative loop stitches that might be created by a looper for use in a row of stitches adjacent to the cut and loop stitches of FIG. 3A in alternating rows. Thus, it will be seen that the a, a' stitches are of approximately the same height so that the cut a stitch from the rear yarn and the looped a' stitch on the front yarn will both be visible. The b' and c' stitches of the front yarn 18 are tufted at a very low or buried height and those stitches will be virtually invisible when surrounded by regular height b and c stitches from the rear yarns 20. The d through j stitches are also tufted at approximately the same height as the d' through j' stitches so that front and rear yarns will both be visible. The front k' and l' stitches are tufted at a buried height so that the rear k and l stitches will be visible. The m and n stitches are tufted at about the same height as the m' and n' stitches so that both front and rear yarns should be visible. By utilizing two yarn colors, typically alternating color placements on each transverse row of needles and shifting the needles transversely in accordance with a predetermined patterns many desirable and heretofore unachievable tufting patterning effects may be created. Furthermore, the reduction in overall yarn height effects significant yarn savings while providing comparable or improved appearance to previous Precision Cut/Uncut™ or Velva Loop™ carpet patterns.

Turning then to FIGS. 4A through 4F, FIG. 4A shows a pattern 60 tufted on a machine configured according to the invention. FIG. 4B shows that the front needle bar, which tufts only loop pile, has an alternating thread up of A yarns 61 and C yarns 62. The rear needle bar which creates both cut and loop stitches is threaded only with B yarns 63. FIG. 4C shows pile height information with front loop stitches being tufted at a low pile height 65 of 0.15 inches and a high pile height 62 of 0.2990 inches. The rear needle bar tufts three pile heights: a medium loop height 67 at 0.24 inches; a full loop height 68 of 0.2990 inches; and a cut pile height 69 of 0.30 inches. In actuality the height difference between cut and loop pile stitches may be several thousandths, but the heights are still relatively close.

FIG. 4D shows the positioning of the full height loop stitches 70 from the front needle bar. These full loop stitches at height 66 will have the same height as the full loop stitches and cut pile stitches 68, 69 from the rear needle bar.

FIG. 4E shows the stitch placement of the full height 71 loop stitches and cut pile height 72 stitches from the rear needle bar. FIG. 4F shows the shifting pattern of the needle bars where it can be seen that the rear needle bar sews straight for both the first two stitches 75 and the second two stitches 77, thus indicating the rear needle bar sews straight throughout the pattern. The front needle bar sews straight the first two stitches 75 and then shifts one gauge step for the next two stitches 76 and it repeats this shift pattern throughout the length of the carpet pattern Although preferred embodiments of the present invention have been disclosed in detail herein, it will be understood that various substitutions and modifications may be made to the embodiments described herein without departing from the scope and spirit of the present invention as recited in the appended claims.

I claim:

1. In a multiple needle tufting machine of the type having a yarn feed control and transversely spaced rows of front yarn carrying needles and rear yarn carrying needles adapted for reciprocation through a backing fabric to form loops of yarn on a face thereof, a yarn seizing apparatus comprising:

a transverse row of reciprocating front loopers adapted to seize yarns from the front yarn carrying needles when penetrating the backing fabric; and a transverse row of reciprocating gated hooks having associated knives, and adapted to seize yarns from the rear yarn carrying needles when penetrating the backing fabric.

2. A yarn seizing apparatus in multiple needle tufting machine according to claim 1 wherein the gated hooks are operable between an open position where yarns seized thereon are brought into contact with associated knives and cut to form cut pile stitches, and a closed position where yarns seized thereon are removed by the reciprocation of the gated hooks to form loop pile stitches without being cut.

3. A yarn seizing apparatus in a multiple needle tufting machine according to claim 2 wherein the cut pile stitches and the loop pile stitches have a height of less than $5/16^{th}$ inches.

4. A yarn seizing apparatus in a multiple needle tufting machine according to claim 2 wherein the reciprocating gated hooks in closed position are adapted to seize yarns to form relatively high loop stitches when relatively greater lengths of yarn are provided to the corresponding rear yarn carrying needles by the yarn feed control and to form relatively low height loop stitches when corresponding the rear yarn carrying needles are fed relatively shorter lengths of yarn by the yarn feed control.

5. A yarn seizing apparatus in a multiple needle tufting machine according to claim 4 wherein the front loopers seize yarns to form relatively high loop stitches when relatively greater lengths of yarn are provided to the corresponding front yarn carrying needles by the yarn feed control, and to form relatively low height loop stitches when the corresponding front yarn carrying needles are fed relatively shorter lengths of yarn by the yarn feed control.

6. A yarn seizing apparatus in a multiple needle tufting machine according to claim 5 wherein the relatively low height loop stitches formed by the front needles and loopers are lower than the relatively low height loop stitches formed by the rear needles and gated hooks.

7. A yarn seizing apparatus in a multiple needle tufting machine according to claim 5 wherein the relatively high loop stitches formed by the front needles and loopers are approximately the same height as the relatively high loop stitches formed by the rear needles and gated hooks.

8. A yarn seizing apparatus in a multiple needle tufting machine according to claim 4 wherein the cut pile stitches are of approximately the same height as the relatively high loop stitches.

9. A yarn seizing apparatus in a multiple needle tufting machine according to claim 1 wherein the front loopers seize yarns to form relatively high loop stitches when relatively greater lengths of yarn are provided to the corresponding front yarn carrying needles by the yarn feed control, and to form relatively low height loop stitches when the corresponding front yarn carrying needles are fed relatively shorter lengths of yarn by the yarn feed control.

10. A method of forming a tufted fabric on a multiple needle tufting of the type having a yarn feed control apparatus supplying yarns to a transversely spaced row of front yarn carrying needles and a yarn feed control providing yarns to a transversely spaced row of rear yarn carrying needles, said front and rear yarn carrying needles being mounted for reciprocation through a backing fabric to form loops of yarn on a face thereof, and said tufting machine having a transverse row of reciprocating front loopers adapted to seize yarns from the front yarn carrying needles when penetrating the backing fabric and a transverse row of reciprocating gated hooks having associated knives and being adapted to seize yarns from the rear yarn carrying needles when penetrating the backing fabric comprising the steps of:

(a) operating the yarn feed control to feed yarns to front yarn carrying needles;

(b) reciprocating said front yarn carrying needles through the backing fabric to form front loops of yarn thereon;

(c) operating a transverse row of front loopers to seize front loops of yarn and retracting the front yarn carrying needles from the backing fabric;

(d) reciprocating the front loopers so that front loops of yarn are dropped from the loopers to form front yarn loop bights;

(e) operating the yarn feed control to supply yarns to rear yarn carrying needles;

(f) reciprocating said rear yarn carrying needles through the backing fabric to form rear loops of yarn on the face thereof;

(g) reciprocating the transverse row of gated hooks to seize rear loops of yarn wherein selected ones of the gated hooks are in a closed position and other selected gated hooks are in an open position and retracting the rear needles from the backing fabric;

(h) reciprocating the gated hooks so that yarn loops on gated hooks in a closed position are dropped from the gated hooks to form loop bights and so that yarn loops on open gated hooks are brought into contact with associated knives and cut to form cut bights; and (i) repeating said steps of yarn feeding and reciprocation in steps (a)-(h) to produce a tufted fabric having a face comprised of front yarn loop bights, rear yarn loop bights and rear yarn cut bights.

11. The method of claim 10 wherein the yarn feed control supplies relatively greater lengths of yarn to selected front needles to produce high front yarn loop bights and relatively shorter lengths of yarn to other front needles, to produce low front yarn loop bights.

12. The method of claim 10 wherein the yarn bights have a height of less than 5/16ths inches.

13. The method of claim 10 wherein the yarn feed control supplies relatively greater lengths of yarn to selected gated hooks in a closed position to produce high rear yarn loop bights and relatively shorter lengths of yarn to other gated hooks in a closed position to produce low rear yarn loop bights.

14. The method of claim 13 wherein the yarn feed control supplies relatively greater lengths of yarn to selected front needles to produce high front yarn loop bights and relatively shorter lengths of yarn to other front needles to produce low front yarn loop bights.

15. The method of claim 12 wherein the high front yarn loop bights have approximately the same height as the high rear yarn loop bights.

16. The method of claim 14 wherein the low front yarn loop bights are of a lower height than the low rear yarn loop bights.

17. The method of claim 16 wherein the low front yarn loop bights are substantially buried from view by adjacent yarn bights.

18. The method of claim 16 wherein the low rear yarn loop bights have a height of less than 0.25 inches.

19. The method of claim 14 wherein the low rear yarn loop bights are substantially buried from view when adjacent to high front yarn loop heights, high rear yarn loop bights and rear yarn cut bights.

20. The method of claim 13 wherein the high rear yarn loop bights are approximately the same height as the rear yarn cut bights.

* * * * *